US009238853B2

(12) United States Patent
Yamada et al.

(10) Patent No.: US 9,238,853 B2
(45) Date of Patent: Jan. 19, 2016

(54) NICKEL-BASE CASTING SUPERALLOY AND CAST COMPONENT FOR STREAM TURBINE USING THE SAME AS MATERIAL

(75) Inventors: Masayuki Yamada, Yokohama (JP); Kiyoshi Imai, Tokyo (JP); Kuniyoshi Nemoto, Yokohama (JP); Shigekazu Miyashita, Kawasaki (JP); Kazutaka Ikeda, Mitaka (JP); Takeo Suga, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 774 days.

(21) Appl. No.: 12/469,383

(22) Filed: May 20, 2009

(65) Prior Publication Data

US 2009/0291016 A1 Nov. 26, 2009

(30) Foreign Application Priority Data

May 21, 2008 (JP) ..... P2008-133495

(51) Int. Cl.

| | |
|---|---|
| ***C22C 19/05*** | (2006.01) |
| ***C22C 30/00*** | (2006.01) |
| ***C22C 19/00*** | (2006.01) |

(52) U.S. Cl.

CPC ..... *C22C 19/056* (2013.01); *C22C 19/007* (2013.01)

(58) Field of Classification Search

CPC .... C22C 19/05; C22C 19/055; C22C 19/056; C22C 19/007

USPC ..... 148/410; 420/449

See application file for complete search history.

(56) References Cited

U.S. PATENT DOCUMENTS

| | | | | |
|---|---|---|---|---|
| 2,840,469 | A | 6/1958 | Gresham et al. | |
| 3,785,877 | A * | 1/1974 | Bailey | 148/556 |
| 4,110,110 | A * | 8/1978 | Kondo et al. | 420/449 |
| 4,118,223 | A | 10/1978 | Acuncius et al. | |
| 4,174,213 | A * | 11/1979 | Fukui et al. | 420/586.1 |
| 4,283,234 | A | 8/1981 | Fukui et al. | |
| 4,302,256 | A * | 11/1981 | Kenton | 148/622 |
| 5,476,555 | A * | 12/1995 | Erickson | 148/410 |
| 5,516,485 | A | 5/1996 | Culling | |
| 5,556,594 | A | 9/1996 | Frank et al. | |
| 7,459,035 | B2 | 12/2008 | Imano et al. | |
| 7,484,926 | B2 | 2/2009 | Suga et al. | |
| 2004/0187973 | A1 | 9/2004 | Takahata et al. | |
| 2005/0236079 | A1 | 10/2005 | Ueta et al. | |
| 2006/0245911 | A1 | 11/2006 | Suga et al. | |
| 2009/0074584 | A1 | 3/2009 | Nemoto et al. | |

FOREIGN PATENT DOCUMENTS

| | | | |
|---|---|---|---|
| CN | 1570171 | A | 1/2005 |
| CN | 1854464 | A | 11/2006 |
| EP | 0 623 325 | A1 | 1/1995 |
| EP | 1 090 710 | | 4/2001 |
| EP | 1 462 533 | A1 | 9/2004 |
| EP | 1 486 578 | A1 | 12/2004 |
| EP | 1 752 614 | A2 | 2/2007 |
| EP | 1 835 040 | | 9/2007 |
| EP | 1 985 719 | | 10/2008 |
| EP | 1 985 719 | A1 | 10/2008 |
| GB | 783955 | | 9/1953 |
| GB | 1 264 006 | | 2/1972 |
| GB | 1264006 | | 2/1972 |
| JP | 2003-13161 | | 1/2003 |
| JP | 3559681 | | 5/2004 |
| JP | 2005-2929 | | 1/2005 |
| JP | 2005-68505 | | 3/2005 |
| JP | 2005-97689 | | 4/2005 |
| JP | 2006-307280 | | 11/2006 |
| JP | 2006-322025 | | 11/2006 |

OTHER PUBLICATIONS

Choudhury, I.A et al.., "Machinability of nickel-base super alloys: a general review", Journal of Materials Processing Technology, 77 (1998), pp. 278-284.*

Penkalla, H.J., et al., "Quantitative microstructural characterization of Ni-base superalloys", Materials Chemistry and Physics 81 (2003), pp. 417-423.*

"Method of Creep and Creep Rupture Test for Metallic Materials", Japanese Industrial Standard, JIS Z 2271, 1999, 36 pages, with English Translation.

U.S. Appl. No. 12/854,507, filed Aug. 11, 2010, Yamada, et al.

Office Action issued on Apr. 13, 2011 in the corresponding Chinese Application No. 200910138966.0 (with Enlgish Translation).

U.S. Appl. No. 12/403,884, filed Mar. 13, 2009, Nemoto, et al.

U.S. Appl. No. 12/395,983, filed Mar. 2, 2009, Kubo, et al.

Office Action issued Dec. 31, 2010, in Chinese Patent Application No. 200910138966.0 with English translation.

European Search Report in Application 09160757.2, issued Aug. 9, 2011.

Office Action mailed on Aug. 10, 2011, in Chinese Patent Application No. 200910138966.0.

Office Action issued Mar. 7, 2012, in Chinese Patent Application No. 201110062643.5 with English translation.

Japanese Office Action issued Aug. 7, 2012, in Japan Patent Application No. 2008-133495 (with English translation).

Chinese Office Action issued Aug. 31, 2012, in China Patent Application No. 201110062643.5 (with English translation).

* cited by examiner

*Primary Examiner* — Jessee Roe

(74) *Attorney, Agent, or Firm* — Oblon, McClelland, Maier & Neustadt, L.L.P.

(57) ABSTRACT

A Ni-base casting superalloy containing, in masse, C: 0.05 to 0.2, Si: 0.01 to 1, Mn: 0.01 to 1, Co: 5 to 20, Fe: 10 or less, Cr: 15 to 25, and one kind or two kinds or more of Mo, W, and Re, with Mo+(W+Re)/2: 8 to 25, the balance being Ni and unavoidable impurities.

14 Claims, No Drawings

NICKEL-BASE CASTING SUPERALLOY AND CAST COMPONENT FOR STREAM TURBINE USING THE SAME AS MATERIAL

CROSS-REFERENCE TO THE RELATED APPLICATIONS

This application is base upon and claims the benefit of priority from the prior Japanese Patent Application No. 2008-133495, filed on May 21, 2008; the entire contents of which are incorporated herein by reference.

BACKGROUND OF THE INVENTION

1. Field of the Invention

The present invention relates to a material forming a turbine casing and a valve casing of a steam turbine into which high-temperature, high-pressure steam flows as a working fluid, and in particular, to a nickel-base casting superalloy for steam turbine superior in high-temperature strength and so on, and to a cast component for steam turbine using the same as its material.

2. Description of the Related Art

In a thermal power plant including a steam turbine, an art to reduce carbon dioxide emission has been drawing attention in view of global environmental protection, and a need for highly efficient power generation has been increasing.

For higher efficiency of the power generation of a steam turbine, it is effective to increase the temperature of turbine steam. Recently, a thermal power plant including a steam turbine uses the steam whose temperature is equal to or higher than 600° C. The future trend is toward a higher steam temperature up to 650° C., further 700° C. or over 700° C.

A turbine casing and a valve casing of a steam turbine into which high-temperature, high-pressure steam flows as a working fluid can be regarded as a kind of a high-temperature pressure vessel receiving a high inner pressure under a high-temperature environment. Therefore, the turbine casing and the valve casing are required to endure high temperature and high stress, which is creating a demand for materials having excellent strength, ductility, and toughness at a high temperature range as materials forming the turbine casing and the valve casing.

Further, the materials need to have excellent steam oxidation resistance because of long use at high temperatures. Further, because of their complicated shapes, the turbine casing and the valve casing are generally molded by casting, and therefore good castability is required so that the occurrence of defects at the time of the casting is prevented as much as possible.

Good weldability is also an important factor as the materials because, in the event of the occurrence of a casting defect, repair-welding is necessary after a defective portion is chipped off and because short pipes, elbow pipes, and so on are joined to the turbine casing and the valve casing by welding (structural welding).

Further, in an inner structure of the turbine casing and the valve casing, they are structurally combined with other components when used. For example, inside the turbine casing, a turbine rotor rotating by steam, rotor blades, nozzles (stator blades), tie bolts, nozzle boxes, and so on are assembled. Therefore, in order to facilitate the structure designing and realize greater reliability over a long period of operation, the turbine casing preferably has the same level of thermal expansion coefficient as those of these inner structure components. Further, as the thermal expansion coefficient is lower, a local heat stress as a large structure is smaller, and from this point of view, easy structure designing and improved long-term reliability are realized.

Therefore, a Ni-base casting superalloy used for a turbine casing and a valve casing is required to have excellent strength (creep rupture strength) and ductility (creep rupture elongation) at high temperatures, excellent steam oxidation resistance, excellent weldability, and a low thermal expansion coefficient.

At present, typical materials as a Ni-base casting superalloy whose use in the application where the steam temperature is 700° C. or over 700° is under consideration are an Inconel 617 superalloy (manufactured by Special Metals Corporation) and an Inconel 625 superalloy (manufactured by Special Metals Corporation). However, though satisfactory in creep rupture elongation, steam oxidation resistance, and weldability, these materials do not have sufficient creep rupture strength and have a relatively large thermal expansion coefficient, which leads to a difficulty in the structure designing of the turbine casing and the valve casing using these materials and involves many problems in terms of long-term stable operation of these turbine casing and valve casing at high temperatures.

Conventionally, the use of an austenitic Ni-base superalloy having a low thermal expansion coefficient for bolts and so on of a steam turbine has been proposed (see, for example, JP-A 2003-13161 (KOKAI)). Further, the use of a NiFe-base superalloy from which it is relatively easy to fabricate a large forged product, in the manufacture of a steam turbine rotor used at high temperatures over 700° C. has been proposed (see, for example, JP-A 2005-2929 (KOKAI)). Another proposal is to use an austenitic Ni-base superalloy having good forgeability and a low thermal expansion coefficient in order to manufacture a steam turbine blade (see, for example, Japanese Patent No. 3559681). However, these arts give no consideration to castability, weldability, and the like.

SUMMARY OF THE INVENTION

As described above, the use of the Ni-base casting superalloy as a material of a turbine casing and a valve casing of a steam turbine whose steam temperature exceeds 700° C. has been under consideration, but it is thought that more improvement in its high-temperature strength (creep rupture strength) is necessary. It is also thought that its thermal expansion coefficient needs to be lowered to a proper level. There is a demand that the Ni-base casting superalloys be given, by composition improvement or the like, the necessary high-temperature strength and thermal expansion coefficient, yet maintain high-temperature ductility (creep rupture elongation), steam oxidation resistance, weldability, and so on.

It is an object of the present invention to provide a Ni-base casting superalloy capable of having improved creep rupture strength and an optimized thermal expansion coefficient, yet maintaining manufacturability such as cast ability and weldability, and to provide a cast component for steam turbine using the Ni-base casting superalloy as a material.

A nickel-base casting superalloy of an aspect of the present invention contains, in mass %, carbon (C): 0.05 to 0.2, silicon (Si): 0.01 to 1, manganese (Mn): 0.01 to 1, cobalt (Co): 5 to 20, iron (Fe): 10 or less, chromium (Cr): 15 to 25, and one kind or two kinds or more of molybdenum (Mo), tungsten (W), and rhenium (Re), with Mo+(W+Re)/2: 8 to 25, the balance being nickel (Ni) and unavoidable impurities.

DESCRIPTION OF THE EMBODIMENTS

Hereinafter, an embodiment of the present invention will be described. A Ni-base casting superalloy of the embodiment according to the present invention is formed in the composing component ranges shown below. Note that, in the following description, 96 representing the contents of the composing components refers to mass % unless otherwise mentioned.

(M1)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, and one kind or two kinds or more of Mo, W, and Re, with Mo+(W+Re)/2: 8 to 25, the balance being Ni and unavoidable impurities.

(M2)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, and Ti: 0.1 to 2.5, the balance being Ni and unavoidable impurities.

(M3)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, and one kind or two kinds of Nb and Ta, with Nb+Ta/2: 0.5 to 5, the balance being Ni and unavoidable impurities.

(M4)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, and B: 0.001 to 0.02, the balance being Ni and unavoidable impurities.

(M5)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, and Zr: 0.01 to 0.2, the balance being Ni and unavoidable impurities.

(M6)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, and one kind or two kinds of Nb and Ta, with Nb+Ta/2: 0.5 to 5, the balance being Ni and unavoidable impurities.

(M7)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, and B: 0.001 to 0.02, the balance being Ni and unavoidable impurities.

(M8)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, and Zr: 0.01 to 0.2, the balance being Ni and unavoidable impurities.

(M9)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, and B: 0.001 to 0.02, the balance being Ni and unavoidable impurities.

(M10)

a Ni-Base Casting Superalloy Containing, in Mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, and Zr: 0.01 to 0.2, the balance being Ni and unavoidable impurities.

(M11)

a Ni-Base Casting Superalloy Containing, in Mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, B: 0.001 to 0.02, and Zr: 0.01 to 0.2, the balance being Ni and unavoidable impurities.

(M12)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, and B: 0.001 to 0.02, the balance being Ni and unavoidable impurities.

(M13)

a Ni-Base Casting Superalloy Containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, and Zr: 0.01 to 0.2, the balance being Ni and unavoidable impurities.

(M14)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, B: 0.001 to 0.02, and Zr: 0.01 to 0.2, the balance being Ni and unavoidable impurities.

(M15)

A Ni-Base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, B: 0.001 to 0.02, and Zr: 0.01 to 0.2, the balance being Ni and unavoidable impurities.

(M16)

A Ni-base casting superalloy containing, in mass %, C: 0.05 to 0.2, Si: 0.01 to 1, Mn: 0.01 to 1, Co: 5 to 20, Fe: 10 or less, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, B: 0.001 to 0.02, and Zr: 0.01 to 0.2, the balance being Ni and unavoidable impurities.

(M17)

The Ni-Base Casting Superalloy Corresponding to any One of the Above M2, M6 to M8, M12 to M14, and M16, in which a content of the Al is 0.2 to 0.3 in mass %.

(M18)

The Ni-Base Casting Superalloy Corresponding to any One of the Above M2, M6 to M8, M12 to M14, and M16, in which a content of the Ti is 0.5 to 2.0 in mass %.

(M19)

The Ni-Base Casting Superalloy Corresponding to any One of the Above M3, M6, M9, M10, M12, M13, M15, and M16, in which a content of one kind or two kinds of the Nb and Ta is Nb+Ta/2=1.0 to 2.5 in mass %.

(M20)

The Ni-Base Casting Superalloy Corresponding to any One of the Above M4, M7, M9, M11, M12, and M14 to M16, in which a content of the B is 0.002 to 0.015 in mass %.

(M21)

The Ni-Base Casting Superalloy Corresponding to any One of the Above M5, M8, M10, M11, and M13 to M16, in which a content of the Zr is 0.02 to 0.10 in mass %.

(M22)

The Ni-Base Casting Superalloy Corresponding to any One of the Above M1 to M21, in which a content of the Co is 7 to 17 in mass %.

(M23)

The Ni-base casting superalloy corresponding to any one of the above M1 to M22, in which a content of one kind or two kinds or more of the Mo, W, and Re is Mo+(W+Re)/2=13 to 20 in mass %.

(M24)

The Ni-Base Casting Superalloy Corresponding to any One of the Above M1 to M23, in which a content of the Cr is 18 to 23 in mass %.

(M25)

The Ni-Base Casting Superalloy Corresponding to any One of the Above M1 to M24, in which a content of the Fe is 5 or less in mass %.

(M26)

The Ni-Base Casting Superalloy Corresponding to any One of the Above M1 to M25, in which a content of the C is 0.07 to 0.15 in mass %.

The Ni-base casting superalloy in any of the composing component ranges is suitable as a material forming cast components such as a turbine casing and a valve casing of a steam turbine whose temperature during the operation becomes 680° C. to 750° C. Here, the cast component such as the turbine casing or the valve casing of the steam turbine may be entirely made of the Ni-base casting superalloy, or in the turbine casing or the valve casing of the steam turbine, a part whose temperature becomes especially high may be made of the Ni-base casting superalloy.

Further, the Ni-base casting superalloy in any of the above composing component ranges contributes to improvement in high-temperature strength while maintaining workability such as castability and weldability of conventional Ni-base casting superalloys. That is, the use of the Ni-base casting superalloy for forming the cast component such as the turbine casing or the valve casing of the steam turbine enables improvement in high-temperature strength of the cast component such as the turbine casing or the valve casing, and the manufactured cast component such as the turbine casing or the valve casing can have high reliability even under a high-temperature environment. Further, when the cast component such as the turbine casing or the valve casing of the steam turbine is manufactured, workability such as castability and weldability of the conventional Ni-base casting superalloys can be maintained.

Next, reasons why each composing component range in the Ni-base casting superalloy according to the embodiment of the present invention described above is limited will be described.

(1) C (Carbon)

C is useful as a constituent element of $M_{23}C_6$ type carbide being a strengthening phase, and is one of the factors that, especially under a high-temperature environment of 650° C. or higher, cause the precipitation of the $M_{23}C_6$ type carbide during the operation of the steam turbine to maintain creep strength of the superalloy. Besides, it prevents the coarsening of crystal grains. It also has an effect of ensuring fluidity of molten metal during the casting. When a content ratio of C is less than 0.05%, a sufficient precipitation amount of the carbide cannot be ensured, and the fluidity of the molten metal during the casting greatly deteriorates. On the other hand, when the content ratio of C is over 0.2%, a component segregation tendency when a large casting is manufactured increases and a generation of $M_6C$ type carbide being an embrittling phase is promoted, causing deterioration in corrosion resistance and ductility. Therefore, the content ratio of C is set to 0.05% to 0.2%. The content ratio is more preferably 0.07% to 0.15%.

(2) Cr (Chromium)

Cr not only solid-dissolves in an austenite parent phase to achieve solid-solution hardening but also is an indispensable element for enhancing oxidation resistance and corrosion resistance. It is also indispensable as a constituent element of the $M_{23}C_6$ type carbide, and especially under a high-temperature environment at 650° C. or higher, it causes the precipitation of the $M_{23}C_6$ type carbide during the operation of the steam turbine, thereby maintaining the creep strength of the superalloy. Besides, Cr enhances oxidation resistance under a high-temperature steam environment. When a content ratio of Cr is less than 15%, oxidation resistance deteriorates. On the other hand, when the content ratio of Cr is over 25%, it greatly promotes the precipitation of the $M_{23}C_6$ type carbide, which tends to make the carbide coarser, and after long hours at high temperatures, it causes deterioration in strength and ductility. Further, since Cr increases a thermal expansion coefficient of the superalloy, its addition amount in designing a high-temperature machine is preferably lower. Therefore, the content ratio of Cr is set to 15% to 25%. The content ratio is more preferably 18% to 23%.

(3) Co (Cobalt)

Co solid-dissolves in the austenite parent phase to improve high-temperature strength. Co, which also solid-dissolves in a γ phase [$Ni_3$ (Al, Ti, Nb, Ta)], has effects of strengthening the γ' phase and increasing a precipitation amount of the γ phase. However, a content ratio of Co over 20% becomes factors of generating an intermetallic compound phase to decrease mechanical strength, and of increasing cost of the superalloy. On the other hand, when the content ratio of Co is less than 5%, mechanical strength lowers. Therefore, the content ratio of Co is set to 5% to 20%. The content ratio is more preferably 7% to 17%.

(4) Mo (Molybdenum), W (Tungsten), Re (Rhenium)

Mo, W, and Re all solid-dissolve in the austenite parent phase to improve high-temperature strength. Further, part thereof is substituted in the $M_{23}C_6$ type carbide to enhance stability of the carbide. They further have an effect of lowering a thermal expansion coefficient of the superalloy, which is useful in designing a high-temperature machine. When a content ratio of Mo+(W+Re)/2 is less than 8%, the aforesaid effects are exhibited only a little, and when the content ratio of Mo+(W+Re)/2 is over 25%, the component segregation tendency when a large casting is manufactured increases and the generation of $M_6C$ type carbide being the embrittling phase is promoted, leading to deterioration in ductility. Therefore, the content ratio of Mo+(W+Re)/2 is set to 8% to 25%. The content ratio is more preferably 13% to 20%.

(5) Al (Aluminum)

Al generates a γ' phase [$Ni_3$(Al, Ti, Nb, Ta)] together with Ni, and causes the precipitation of the γ' phase to improve mechanical strength of the Ni-base casting superalloy. It also has an effect of improving high-temperature and corrosion resistance. When a content ratio of Al is less than 0.1%, the precipitation of the γ' phase is not sufficient and the strengthening effect is not exhibited, and if Ti, Nb, and Ta exist in large amount, the γ' phase becomes unstable and a ηphase ($Ni_3Ti$) and δ phase [$Ni_3$(Nb, Ta)] precipitate, resulting in embrittlement. On the other hand, its addition in large amount causes the precipitation of a large amount of a eutectic γ' phase, causing deterioration in high-temperature strength and a casting crack. Therefore, the content ratio of Al is set to 0.1% to 0.4%. The content ratio is more preferably 0.2% to 0.3%.

(6) Ti (Titanium)

Similarly to Al, Ti generates the γ' phase [$Ni_3$(Al, Ti, Nb, Ta)] together with Ni, and causes the precipitation of the γ' phase to improve mechanical strength of the Ni-base casting superalloy. Ti also has an effect of decreasing a thermal expansion coefficient of the superalloy, which is useful in designing a high-temperature machine. When a content ratio of Ti is less than 0.1%, the aforesaid effects are not exhibited, and when the content ratio of Ti is over 2.5%, the precipitation of the η phase ($Ni_3Ti$) as the embrittling phase is promoted, leading to deterioration in high-temperature strength and increase in notch sensitivity. Therefore, the content ratio of Ti is set too. % to 2.5%. The concentration is more preferably 0.5% to 2.0%.

(7) B (Boron)

B enters a crystal grain boundary to improve high-temperature strength. Further, when an amount of Ti is large, the precipitation of the η phase ($Ni_3Ti$) as the embrittling phase is reduced, so that deterioration in high-temperature strength and ductility is prevented. Further, since B with Cr or the like forms boride and a melting point of the boride is low, a solid-liquid coexisting temperature range is widened, which improves castability. When a content ratio of B is less than 0.001%, the aforesaid effects are not exhibited, and when the content ratio of B is over 0.02%, intergranular embrittlement is caused, which may possibly result in deterioration in high-temperature strength and toughness. Therefore, the content ratio of B is set to 0.001% to 0.02%. The content ratio is more preferably 0.002% to 0.015%.

(8) Nb (Niobium), Ta (Tantalum)

Nb and Ta solid-dissolve in the γ phase [$Ni_3$(Al, Ti, Nb, Ta)] to enhance high-temperature strength, inhibit the coarsening of the γ' phase, and stabilize precipitation intensity. Further, when Nb and Ta are bound to C to form carbide, they contribute to improvement in high-temperature strength. When a content ratio of Nb+Ta/2 is less than 0.5%, the aforesaid effects are not exhibited and when the content ratio of Nb+Ta/2 is over 5%, the 8 phase [$Ni_3$ (Nb, Ta)] precipitates, resulting in embrittlement. Therefore, the content ratio of Nb+Ta/2 is set to 0.5% to 5%. The content ratio is more preferably 1% to 2.5%.

(9) Zr (Zirconium)

Similarly to B, Zr enters a crystal grain boundary to improve high-temperature strength. Further, when it is bound to C to form carbide, it contributes to improvement in high-temperature strength. When a content ratio of Zr is less than 0.01%, the aforesaid effects are not exhibited, and when the content ratio of Zr is over 0.2%, high-temperature strength lowers on the contrary and deterioration in ductility is also caused. Therefore, the content ratio of Zr is set to 0.01% to 0.2%. The content ratio is more preferably 0.02% to 0.1%.

(10) Fe (Iron)

Fe contributes to a cost reduction of the superalloy in a Ni-base superalloy casting. However, its addition in large amount not only causes deterioration in high-temperature strength but also leads to an increase in a thermal expansion coefficient of the superalloy, which is disadvantageous in designing a high-temperature machine. Therefore, a content ratio of Fe is set to 10% or less. The content ratio is more preferably 5% or less.

(11) Si (Silicon)

Si is useful as a deoxidizer at the time of dissolution and refining. It also improves oxidation resistance. However, if its content is too large, deterioration in ductility is caused. A proper Si content is set to 0.01% to 1%. The content ratio is more preferably 0.02% to 0.5%.

(12) Mn (Manganese)

Similarly to Si, Mn is useful as a deoxidizer at the time of dissolution and refining. However, when its content is too large, deterioration in high-temperature oxidation resistance and deterioration in ductility due to the precipitation of the η phase ($Ni_3Ti$) is caused. A proper Mn content ratio is set to 0.01% to 1%. The content ratio is more preferably 0.1% to 0.3%.

Hereinafter, it will be described that the Ni-base casting superalloys according to this embodiment are excellent in mechanical properties (creep rupture strength and creep rupture elongation which are typical properties of high-temperature strength), steam oxidation resistance, low thermal expansion coefficient, and weldability.

(Chemical Compositions of Samples)

Table 1 shows chemical compositions of various kinds of samples which were used for the evaluation in order to show that the Ni-base casting superalloys according to this embodiment are excellent in mechanical properties (creep rupture strength and creep rupture elongation which are typical properties of high-temperature strength), steam oxidation resistance, low thermal expansion coefficient, and weldability. These samples were subjected to predetermined heat treatment. Table 1 shows sample No. 1 to sample No. 29 as examples of the Ni-base casting superalloy according to this embodiment, and sample No. 1 to sample No. 11 as comparative examples. The comparative examples are Ni-base casting superalloys whose chemical compositions do not fall within the chemical composition range of this embodiment, and among them, sample No. 1 has a chemical composition corresponding to that of Inconel 617 which is a conventional casting superalloy, and sample No. 2 has a chemical composition corresponding to that of Inconel 625 which is a conventional superalloy.

TABLE 1

| | No. | Co | Fe | Cr | Mo | W | Re | Al | Ti | Nb | Ta | C |
|---|---|---|---|---|---|---|---|---|---|---|---|---|
| EXAMPLE | 1 | 8.2 | 4.6 | 22.2 | 13.1 | 6.2 | 0.41 | — | — | — | — | 0.07 |
| | 2 | 13.1 | 5.1 | 22.1 | 13.2 | — | — | — | — | — | — | 0.07 |
| | 3 | 13.2 | 5.1 | 22.6 | 13 | 6 | — | — | — | — | — | 0.05 |
| | 4 | 13 | 5.3 | 22.5 | 17.4 | 6.2 | — | — | — | — | — | 0.06 |
| | 5 | 12.9 | 4.6 | 22.3 | 13.2 | 6.1 | 0.22 | — | — | — | — | 0.07 |
| | 6 | 13.2 | 4.8 | 21.9 | 13.2 | 10.5 | 0.21 | — | — | — | — | 0.08 |
| | 7 | 13.1 | 5.1 | 22.3 | 13.4 | 9.8 | 0.4 | — | — | — | — | 0.08 |
| | 8 | 13.4 | 5.2 | 22.4 | 12.8 | 6.1 | 0.38 | 0.2 | 0.41 | — | — | 0.09 |
| | 9 | 13 | 5.5 | 22.6 | 13.3 | 6.2 | 0.4 | 0.22 | 1.52 | — | — | 0.07 |
| | 10 | 13.3 | 4.7 | 21.6 | 13.2 | 6.4 | 0.41 | — | — | 2.1 | — | 0.09 |
| | 11 | 13.1 | 4.6 | 21.7 | 13 | 6.3 | 0.36 | — | — | 2.1 | 0.9 | 0.09 |
| | 12 | 12.8 | 5.1 | 22 | 13.5 | 6.4 | 0.42 | — | — | 3.2 | 1 | 0.07 |
| | 13 | 13 | 5.2 | 22.1 | 13.2 | 5.9 | 0.43 | — | — | — | — | 0.07 |
| | 14 | 13 | 4.8 | 22.4 | 12.8 | 6.1 | 0.41 | — | — | — | — | 0.07 |
| | 15 | 13.3 | 4.9 | 22.6 | 12.7 | 6.3 | 0.43 | — | — | — | — | 0.08 |
| | 16 | 13.1 | 5.1 | 22.1 | 13.2 | 5.8 | 0.41 | — | — | — | — | 0.07 |
| | 17 | 13.2 | 5 | 22.2 | 13.4 | 6.4 | 0.19 | 0.22 | 1.5 | 2.2 | 1 | 0.08 |
| | 18 | 12.8 | 5.3 | 22.3 | 13.2 | 6.2 | 0.22 | 0.21 | 1.51 | — | — | 0.07 |

TABLE 1-continued

| | | | | | | | | | | | | |
|---|---|---|---|---|---|---|---|---|---|---|---|---|
| | 19 | 13.1 | 5.5 | 22.1 | 13.6 | 6 | 0.2 | 0.22 | 1.54 | — | — | 0.09 |
| | 20 | 13.4 | 4.9 | 21.8 | 13 | 6 | 0.2 | — | — | 2 | 1.1 | 0.07 |
| | 21 | 13.2 | 4.8 | 22.2 | 13.2 | 6.2 | 0.22 | — | — | 2.1 | 1.2 | 0.08 |
| | 22 | 12.7 | 5.1 | 22 | 13.1 | 6.1 | 0.23 | — | — | — | — | 0.08 |
| | 23 | 13.2 | 5.4 | 22.1 | 13.4 | 6.3 | 0.18 | 0.2 | 1.54 | 2 | 1 | 0.08 |
| | 24 | 13.4 | 4.8 | 22.7 | 13.2 | 6.3 | 0.19 | 0.23 | 1.51 | 2.2 | 0.9 | 0.07 |
| | 25 | 13.3 | 4.6 | 21.8 | 12.9 | 6.2 | 0.2 | 0.2 | 1.52 | — | — | 0.09 |
| | 26 | 13.3 | 5.1 | 22.4 | 12.8 | 6.1 | 0.22 | — | — | 1.9 | 1 | 0.07 |
| | 27 | 12.8 | 5.1 | 22.5 | 13.2 | 5.8 | 0.19 | 0.21 | 1.53 | 2.1 | 1.1 | 0.07 |
| | 28 | 12.7 | 5.4 | 22.5 | 16.2 | — | — | 0.21 | 1.52 | 2 | 1.1 | 0.08 |
| | 29 | 13 | 5 | 22.2 | 14.1 | 4.2 | — | 0.22 | 1.54 | 2.1 | 1.3 | 0.08 |
| Comparative Example | 1 | 12.4 | 0 | 22.3 | 9.2 | — | — | 1.12 | 0.31 | — | — | 0.07 |
| | 2 | 0 | 2.5 | 21.3 | 9.4 | — | — | 0.23 | 0.22 | 3.6 | — | 0.05 |
| | 3 | 13.1 | 5.1 | 11.2 | 13.2 | — | — | — | — | — | — | 0.09 |
| | 4 | 12.8 | 4 | 29.5 | 13.2 | — | — | — | — | — | — | 0.08 |
| | 5 | 13.2 | 4.8 | 22.1 | 4.8 | 2.1 | — | — | — | — | — | 0.07 |
| | 6 | 13.1 | 5.2 | 22.3 | 20.4 | 10.6 | 2.02 | — | — | — | — | 0.09 |
| | 7 | 13.4 | 5.5 | 22.3 | 12.8 | 6.2 | 0.21 | 0.21 | 0.05 | — | — | 0.08 |
| | 8 | 13.5 | 4.7 | 22.2 | 12.8 | 6.2 | 0.2 | 0.2 | 3.51 | — | — | 0.07 |
| | 9 | 12.9 | 5.2 | 21.8 | 12.6 | 6 | 0.42 | 0.22 | 1.6 | 4.2 | 2.1 | 0.09 |
| | 10 | 13.2 | 5 | 22.4 | 12.7 | 6.1 | 0.43 | 0.23 | 1.54 | — | — | 0.07 |
| | 11 | 13.1 | 5.1 | 22.1 | 13.3 | 5.9 | 0.4 | 0.21 | 1.55 | — | — | 0.08 |

| | No. | B | Zr | Si | Mn | Ni | Mo + (W + Re)/2 | Nb + Ta/2 | |
|---|---|---|---|---|---|---|---|---|---|
| EXAMPLE | 1 | — | — | 0.31 | 0.22 | b | 16.405 | 0 | |
| | 2 | — | — | 0.33 | 0.23 | b | 13.2 | 0 | |
| | 3 | — | — | 0.29 | 0.21 | b | 16 | 0 | |
| | 4 | — | — | 0.28 | 0.2 | b | 20.5 | 0 | |
| | 5 | — | — | 0.3 | 0.2 | b | 16.36 | 0 | |
| | 6 | — | — | 0.32 | 0.21 | b | 18.555 | 0 | |
| | 7 | — | — | 0.3 | 0.2 | b | 18.5 | 0 | |
| | 8 | — | — | 0.3 | 0.22 | b | 16.04 | 0 | |
| | 9 | — | — | 0.31 | 0.2 | b | 16.6 | 0 | |
| | 10 | — | — | 0.32 | 0.21 | b | 16.605 | 2.1 | |
| | 11 | — | — | 0.3 | 0.23 | b | 16.33 | 2.55 | |
| | 12 | — | — | 0.33 | 0.2 | b | 16.91 | 3.7 | |
| | 13 | 0.005 | — | 0.34 | 0.23 | b | 16.365 | 0 | |
| | 14 | 0.011 | — | 0.31 | 0.22 | b | 16.055 | 0 | |
| | 15 | — | 0.02 | 0.3 | 0.21 | b | 16.065 | 0 | |
| | 16 | — | 0.12 | 0.31 | 0.2 | b | 13.305 | 0 | |
| | 17 | — | — | 0.33 | 0.2 | b | 16.695 | 2.7 | |
| | 18 | 0.012 | — | 0.3 | 0.21 | b | 16.41 | 0 | |
| | 19 | — | 0.12 | 0.31 | 0.21 | b | 16.7 | 0 | |
| | 20 | 0.004 | — | 0.31 | 0.2 | b | 16.1 | 2.55 | |
| | 21 | — | 0.13 | 0.33 | 0.22 | b | 16.41 | 2.7 | |
| | 22 | 0.005 | 0.13 | 0.31 | 0.23 | b | 16.265 | 0 | |
| | 23 | 0.005 | — | 0.32 | 0.21 | b | 16.64 | 2.5 | |
| | 24 | — | 0.12 | 0.3 | 0.2 | b | 16.445 | 2.65 | |
| | 25 | 0.006 | 0.13 | 0.32 | 0.2 | b | 16.1 | 0 | |
| | 26 | 0.005 | 0.11 | 0.33 | 0.21 | b | 15.96 | 2.4 | |
| | 27 | 0.007 | 0.12 | 0.3 | 0.2 | b | 16.195 | 2.65 | |
| | 28 | 0.006 | 0.12 | 0.34 | 0.21 | b | 16.2 | 2.55 | |
| | 29 | 0.006 | 0.13 | 0.3 | 0.21 | b | 16.2 | 2.75 | |
| Comparative Example | 1 | — | — | 0.23 | 0.13 | b | 9.2 | 0 | IN617 |
| | 2 | — | — | 0.31 | 0.2 | b | 9.4 | 3.6 | IN625 |
| | 3 | — | — | 0.3 | 0.21 | b | 13.2 | 0 | Cr below lower limit |
| | 4 | — | — | 0.3 | 0.2 | b | 13.2 | 0 | Cr over upper limit |
| | 5 | — | — | 0.33 | 0.22 | b | 5.85 | 0 | Mo + (W + Re)/2 below lower limit |
| | 6 | — | — | 0.32 | 0.23 | b | 26.71 | 0 | Mo + (W + Re)/2 over upper limit |
| | 7 | — | — | 0.3 | 0.2 | b | 16.005 | 0 | Ti below lower limit |
| | 8 | — | — | 0.34 | 0.21 | b | 16 | 0 | Ti over upper limit |
| | 9 | — | — | 0.3 | 0.2 | b | 15.81 | 5.25 | Nb + Ta/2 over upper limit |
| | 10 | 0.028 | — | 0.31 | 0.21 | b | 15.965 | 0 | B over upper limit |
| | 11 | — | 0.26 | 0.31 | 0.22 | b | 16.45 | 0 | Zr over upper limit |

*b = balance (Creep Rupture Test)

In the creep rupture test, the Ni-base casting superalloys, each being 20 kg, corresponding to sample No. 1 to sample No. 29 as the examples and sample No. 1 to sample No. 11 as the comparative examples all of which have the chemical compositions shown in Table 1 were dissolved in an atmospheric melting furnace and were poured into molds, and specimens with a predetermined size were fabricated from solidified ingots. On each of the samples, the creep rupture test was conducted under the condition of 700° C. and 250 MPa. The creep rupture test was conducted based on JIS Z 2271 (a method for creep and creep rupture test for metallic materials). Table 2 shows creep rupture time (hr) and creep rupture elongation (6) which are obtained as properties obtained in the creep rupture test. Sample No. 1 to sample No. 29 as the examples exhibited the creep rupture times greatly longer than those of sample No. 1 (corresponding to Inconel 617) as the comparative example and sample No. 2 (corresponding to Inconel 625) as the comparative example which are both the conventional casting superalloys, and thus obviously have improved creep rupture strength. Further, all of sample No. 1 to sample No. 29 as the examples exhibited the creep rupture times greatly longer than those of comparative example No. 5 in which the content of Mo+(W+Re)/2 is below the lower limit of the chemical composition range of this embodiment and comparative example No. 7 in which the content of Ti is below the lower limit of the chemical composition range of this embodiment, and thus have improved creep rupture strength. On the other hand, comparative example No. 6 in which the content of Mo+(W+Re/2) is over the upper limit of the chemical composition range of this embodiment, comparative example No. 8 in which the content of Ti is over the upper limit of the chemical composition range of this embodiment, and comparative example No. 9 in which the content of Nb+Ta/2 is over the chemical composition range of this embodiment were all remarkably low in creep rupture elongation, though improvement in creep rupture time was observed therein.

TABLE 2

| | No. | Creep rupture time (hr) (700° C. × 250 MPa) | Creep rupture elongation (%) (700° C. × 250 MPa) | Increase amount due to steam oxidation (mg/cm$^2$) (700° C. × 3000 hr) | Average thermal expansion coefficient (×10$^{-6}$/° C.) (room temperature to 700° C.) | Presence/absence of crack due to welding/high-temperature (Bead-on Welding) |
|---|---|---|---|---|---|---|
| EXAMPLE | 1 | 1210.5 | 15.7 | 0.88 | 14.1 | without |
| | 2 | 1203.8 | 15 | 0.85 | 14.5 | without |
| | 3 | 1397.5 | 15.2 | 0.92 | 14.3 | without |
| | 4 | 1589.4 | 16.1 | 0.95 | 13.2 | without |
| | 5 | 1620.6 | 14.9 | 0.82 | 14 | without |
| | 6 | 1721.8 | 15 | 0.99 | 13.5 | without |
| | 7 | 1804.5 | 15.3 | 0.8 | 13.7 | without |
| | 8 | 2050.6 | 12.5 | 0.75 | 13.8 | without |
| | 9 | 2213.7 | 12 | 0.72 | 13.6 | without |
| | 10 | 1894.6 | 13.1 | 0.85 | 14.2 | without |
| | 11 | 2018.2 | 13.1 | 0.82 | 14 | without |
| | 12 | 2090.7 | 12.8 | 0.8 | 14.4 | without |
| | 13 | 1926.4 | 10.5 | 0.83 | 14.1 | without |
| | 14 | 1990.6 | 10.5 | 0.91 | 14.1 | without |
| | 15 | 1902.7 | 10 | 0.95 | 14.3 | without |
| | 16 | 2030.8 | 11 | 1.01 | 14.2 | without |
| | 17 | 2434.9 | 8.8 | 0.81 | 13.5 | without |
| | 18 | 2510.2 | 11 | 0.78 | 13.2 | without |
| | 19 | 2489.7 | 11.2 | 0.79 | 13.6 | without |
| | 20 | 2179.6 | 12.5 | 0.89 | 14.3 | without |
| | 21 | 2206.5 | 12.5 | 0.97 | 14.1 | without |
| | 22 | 2020.3 | 10.7 | 0.86 | 14.2 | without |
| | 23 | 2303.7 | 9.7 | 0.72 | 13.7 | without |
| | 24 | 2279.9 | 9.5 | 0.77 | 13.8 | without |
| | 25 | 2623.7 | 9.7 | 0.75 | 13.6 | without |
| | 26 | 2323.5 | 12.3 | 0.94 | 14 | without |
| | 27 | 2560.4 | 10.5 | 0.72 | 13.5 | without |
| | 28 | 2477.8 | 9.7 | 0.7 | 13.7 | without |
| | 29 | 2510.8 | 9.3 | 0.78 | 13.2 | without |
| COMPARATIVE EXAMPLE | 1 | 698.5 | 11.5 | 0.65 | 15.1 | without |
| | 2 | 421.8 | 13.2 | 0.75 | 15.3 | without |
| | 3 | 1105.5 | 16.8 | 2.82 | 13.5 | without |
| | 4 | 1598.3 | 12 | 0.61 | 16.7 | without |
| | 5 | 298.5 | 14.8 | 0.9 | 15.8 | without |
| | 6 | 2221.6 | 4.8 | 1.03 | 12.5 | without |
| | 7 | 604.1 | 14.2 | 0.96 | 13.9 | without |
| | 8 | 2488.6 | 5.5 | 0.91 | 12.9 | with |
| | 9 | 2476.2 | 5 | 1.05 | 13.6 | with |
| | 10 | 2587.5 | 9.3 | 0.97 | 13.3 | with |
| | 11 | 2580.5 | 9.7 | 0.94 | 13.5 | with |

(Steam Oxidation Test)

In the steam oxidation test, as in the creep rupture test, specimens with a 10 mm width, a 15 mm length, and a 3 mm thickness were taken from the Ni-base casting superalloys corresponding to sample No. 1 to sample No. 29 as the examples and sample No. 1 to sample No. 11 as the comparative examples all of which have the chemical compositions shown in Table 1, and they were exposed in a 700° C. steam environment for 3000 hours, and an increase amount (mg/cm$^2$) due to the oxidation after the exposure was measured. Table 2 shows the results. The increase amounts due to the steam oxidation of sample No. 1 to sample No. 29 as the examples were all on the same level as those of sample No. 1 (corresponding to Inconel 617) as the comparative example and sample No. 2 (corresponding to Inconel 625) as the comparative example which are both the conventional casting superalloys, and it was found out that sample No. 1 to sample No. 29 as the examples have good steam oxidation resistance. However, the increase amounts due to the steam oxidation of all of sample No. 1 to sample No. 29 as the examples were smaller than those of comparative example No. 3 in which the content of Cr is below the lower limit of the chemical composition range of this embodiment, and thus sample No. 1 to sample No. 29 as the examples exhibited remarkably improved steam oxidation resistance.

(Measurement of Average Thermal Expansion Coefficient)

In the measurement of the average thermal expansion coefficient, as in the creep rupture test and the steam oxidation test, round-rod specimens with a 5 mm diameter and a 19 mm length were taken from the Ni-base casting superalloys corresponding to sample No. 1 to sample No. 29 as the examples and sample No. 1 to sample No. 11 as the comparative examples all of which have the chemical compositions shown in Table 1, and the average thermal expansion coefficients were measured by using a thermomechanical analysis apparatus manufactured by Rigaku Corporation. As standard samples, quartz was used, and average thermal expansion coefficients when the temperature was raised from room temperature up to 700° C. were measured under the condition of temperature increase rate of 5° C./minute by a differential expansion method. Table 2 shows the results. It is obvious that the average thermal expansion coefficients of all of sample No. 1 to No. 29 as the examples under the temperature change from room temperature up to 700° C. are lower than those of sample No. 1 (corresponding to Inconel 617) as the comparative example and sample No. 2 (corresponding to Inconel 625) as the comparative example which are both the conventional casting superalloys. Further, it is obvious that the average thermal expansion coefficients of all of sample No. 1 to No. 29 as the examples under the temperature change from room temperature up to 700° C. are lower than those of comparative example No. 4 in which the content of Cr is over the upper limit of the chemical composition range of this embodiment and comparative example No. 5 in which the content of Mo+(W+Re)/2 is below the lower limit of the chemical composition range of this embodiment.

(Weldability Test)

In the weldability test, as in the creep rupture test, the steam oxidation test, and the measurement of the average thermal expansion coefficient, flat plates with a 150 mm length, an 80 mm width, and a 20 mm thickness were fabricated from the Ni-base casting superalloys corresponding to sample No. 1 to sample No. 29 as the examples and sample No. 1 to sample No. 11 as the comparative examples all of which have the chemical compositions shown in Table 1, surfaces thereof were subjected to 3-pass welding by predetermined welding rods, and thereafter, the presence/absence of the occurrence of a crack was examined on five sections vertical to welding beads. Table 2 shows the results. As for the presence/absence of the crack occurrence, "without" represents that crack occurrence was not confirmed in any of the five sections, and "with" represents that the crack occurrence was confirmed in one section or more out of the five sections. The results on sample No. 1 to sample No 29 as the examples were all "without". Further, the results on sample No. 1 (corresponding to Inconel 617) as the comparative example and sample No. 2 (corresponding to Inconel 625) as the comparative example which are both the conventional casting superalloys were also "without". Further, the results on comparative example No. 3 in which the content of Cr is below the lower limit of the chemical composition range of this embodiment, comparative example No. 4 in which the content of Cr is over the upper limit of the chemical composition range of this embodiment, comparative example 5 in which the content of Mo+(W+Re)/2 is below the lower limit of the chemical composition range of this embodiment, comparative example No. 6 in which the content of Mo+(W+Re)/2 is over the upper limit of the chemical composition range of this embodiment, and comparative example No. 7 in which the content of Ti is below the lower limit of the chemical composition range of this embodiment were all "without", but the results of comparative example No. 8 in which the content of Ti is over the upper limit of the chemical composition range of this embodiment, comparative example No. 9 in which the content of Nb+Ta/2 is over the upper limit of the chemical composition range of this embodiment, comparative example No. 10 in which the content of B is over the upper limit of the chemical composition range of this embodiment, and comparative example No. 11 in which the content of Zr is over the upper limit of the chemical composition range of this embodiment were all "with".

The present invention is not limited to the contents described in the foregoing embodiment, but any change may be made without departing from the spirits of the present invention.

What is claimed is:

1. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25, and
one kind or two kinds of niobium (Nb) and tantalum (Ta), with Nb +Ta/2: 1 to 5.

2. The nickel-base casting superalloy according to claim 1, wherein a content of one kind or two kinds of said niobium (Nb) and tantalum (Ta) is Nb +Ta/2=1.0 to 2.5 in mass %.

3. The nickel-base casting superalloy according to claim 1, which exhibits a creep rupture time, measured at 700° C. at 250 MPa, of from 1397.5 to 2623.7 hours and which exhibits a creep rupture elongation percentage, measured at 700° C. at 250 MPa, of from 9.3 to 16.1%.

4. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
aluminum (Al): 0.1 to 0.4,
titanium (Ti): 0.1 to 2.5, and
one kind or two kinds of niobium (Nb) and tantalum (Ta), with Nb +Ta/2: 1 to 5,
the balance being nickel (Ni) and unavoidable impurities.

5. The nickel-base casting superalloy according to claim 4, wherein a content of said aluminum (Al) is 0.2 to 0.3 in mass %.

6. The nickel-base casting superalloy according to claim 4, wherein a content of said titanium (Ti) is 0.5 to 2.0 in mass %.

7. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 7 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
one kind or two kinds of niobium (Nb) and tantalum (Ta), with Nb +Ta/2: 1 to 5, and boron (B): 0.001 to 0.02.

8. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
one kind or two kinds of niobium (Nb) and tantalum (Ta), with Nb +Ta/2: 1 to 5, and zirconium (Zr): 0.01 to 0.2.

9. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
aluminum (Al): 0.1 to 0.4,
titanium (Ti): 0.1 to 2.5,
one kind or two kinds of niobium (Nb) and tantalum (Ta), with Nb +Ta/2: 1 to 5, and
boron (B): 0.001 to 0.02.

10. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
aluminum (Al): 0.1 to 0.4,
titanium (Ti): 0.1 to 2.5,
one kind or two kinds of niobium (Nb) and tantalum (Ta), with Nb +Ta/2: 0.5 to 5, and
zirconium (Zr): 0.01 to 0.2.

11. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/ 2: 20.5 to 25,
one kind or two kinds of niobium (Nb) and tantalum (Ta), with Nb +Ta/ 2: 0.5 to 5,
boron (B): 0.001 to 0.02, and
zirconium (Zr): 0.01 to 0.2.

12. A nickel-base casting superalloy comprising, in mass %,
nickel,
carbon (C): 0.05 to 0.2,
silicon (Si): 0.01 to 1,
manganese (Mn): 0.01 to 1,
cobalt (Co): 13 to 17,
iron (Fe): 5.3 or less,
chromium (Cr): 15 to 25,
molybdenum (Mo): 12.8 to 17.4, and at least one of tungsten (W) and rhenium (Re), provided that the total amount of molybdenum, tungsten, and rhenium satisfies: Mo +(W +Re)/2: 20.5 to 25,
aluminum (Al): 0.1 to 0.4,
titanium (Ti): 0.1 to 2.5,
one kind or two kinds of niobium (Nb) and tantalum (Ta), with Nb +Ta/2: 1 to 5,
boron (B): 0.001 to 0.02, and
zirconium (Zr): 0.01 to 0.2.

13. The nickel-base casting superalloy according to any one of claims 1, 4, 7, 8, 9, 10, 11, and 12, being applied to a cast component of a steam turbine.

14. A cast component for a steam turbine of a steam turbine plant to which a high-temperature steam is introduced, the cast component being at least partly made of the nickel-base casting superalloy according to any one of claims 1, 4, 7, 8, 9, 10, 11, and 12.

* * * * *